US005128651A

United States Patent [19]

Heckart, deceased

[11] Patent Number: 5,128,651

[45] Date of Patent: Jul. 7, 1992

[54] SCHOOL BUS ALARM SYSTEM

[76] Inventor: Daniel Heckart, deceased, late of/ by Mary A. Heckart, legal representative, 106 S. Prospect, Sedalia, Mo. 65301

[21] Appl. No.: 636,876

[22] Filed: Jan. 2, 1991

[51] Int. Cl.[5] ..... G08B 5/00

[52] U.S. Cl. ..... 340/433; 340/457

[58] Field of Search ..... 340/433, 425.5, 438, 340/457, 305-307, 328

[56] References Cited

U.S. PATENT DOCUMENTS 1,628,493 5/1927 Donahoe ..... 340/433 X
2,302,872 11/1942 Landrum ..... 340/425.5 X
3,744,022 7/1973 Olsen ..... 340/425.5

*Primary Examiner*—Jin F. Ng
*Assistant Examiner*—Brian R. Tumm
*Attorney, Agent, or Firm*—Kokjer, Kircher, Bowman & Johnson

[57] ABSTRACT

An alarm system for vehicles such as school buses which forces the driver to walk through the vehicle to silence the alarm at the end of each route so that he will detect the presence of passengers remaining on board. An ignition relay is energized whenever the ignition switch is on. An arming relay for the alarm is energized when the door switch of the bus is first activated. An override relay is also energized when the door switch is first activated. Alternative circuits for the arming relay include one set of the override relay contacts and a disable switch for the alarm located at the back of the bus. The alarm sounds when the ignition switch is turned off and can be deactivated only by depressing the disable switch at the rear of the bus.

13 Claims, 1 Drawing Sheet

SCHOOL BUS ALARM SYSTEM

BACKGROUND AND SUMMARY OF THE INVENTION

This invention relates generally to a vehicle alarm system and more specifically to an alarm system which is particularly applicable to school buses and which forces the bus driver to walk to the rear of the bus before it is stored, thereby allowing him or her to detect the presence of any children or other passengers who may remain on the bus.

After unloading all passengers at the end of the day, school buses are normally driven to a storage yard for overnight or over the weekend storage. Bus company policy typically requires the driver to make a "walk-through" examination of the bus to make certain that no passengers inadvertently remain on board the bus. However, drivers do not always follow the prescribed policy, and there have been notable incidents where school children have fallen asleep on the bus and been locked inside of it overnight due to the failure of the driver to notice their presence. Drivers are often anxious to complete their shift and do not take the time to walk through the bus and look for sleeping children or others who may remain on board. If small children are inadvertently locked in a bus overnight or even for a shorter period, the consequences can be severe.

It is thus evident that there is a significant need to force drivers of school buses and other vehicles to walk through the vehicle at the end of the route in order to prevent children from possibly being locked on the bus and subjected to cold, fright and other unpleasant experiences. It is the principal goal of the present invention to provide an alarm system that forces a driver of a school bus or other vehicle to walk to the rear of the vehicle before it is stored at the end of each route.

More specifically, the present invention is directed to an alarm system that generates an audible sound when the ignition of the vehicle is turned off and requires the driver to walk to the rear of the vehicle and operate a switch in order to silence the alarm. By making the driver walk through the bus, the alarm system forces him to check the seats for the presence of any remaining passengers even if he is disinclined to do so.

In accordance with the invention, the audible alarm sound may be generated by the existing horn of the vehicle, and the system also makes use of the existing ignition switch, batter and safety system door switch of the bus. The alarm system includes electrical wiring and components which may take the form of relays that perform various functions. One relay is wired to the ignition so that it is energized whenever the ignition is on in order to interrupt the circuit which activates the horn. Another relay is an arming relay which is wired so that it arms the horn when the door switch of the bus safety system is activated at the first stop or when the red warning lights are energized at the first stop. The arming relay is energized along two different paths, one of which includes a normally closed disable switch located at the rear of the bus and the other of which is provided by a third relay which overrides the disable switch so that the disable switch is only effective to disarm the horn after the ignition has been turned off. The override relay is energized by the first activation of the door switch and remains energized until the ignition is shut off, after which the disable switch can be operated to disarm the horn and silence it.

By virtue of this arrangement, the horn is armed automatically upon initial opening of the door (or initial energization of the warning lights), and the driver cannot keep it from becoming armed or otherwise tamper with it. At the same time, if the safety system of the bus is never activated, the door switch (or warning light system) never acts to arm the alarm and the bus can be driven without passengers and not activate the alarm system at the end of the run.

Once the alarm system has been armed, the alarm will sound as soon as the ignition is turned off. Before the ignition is turned off, the disable switch is ineffective to disarm the alarm system, so the driver cannot defeat the alarm by having the last child to be let off deactivate the system. When the alarm signal sounds, the driver can turn the ignition back to the on position to silence it, but he then must walk through the bus and manually operate the disable switch situated at the rear of the bus before he can turn the ignition key off again without the alarm sounding. This requires him to walk through the bus so that he will notice the presence of any children that may remain on board, either because they have fallen asleep or otherwise.

Other and further objects of the invention, together with the features of novelty appurtenant thereto, will appear in the course of the following description.

DESCRIPTION OF THE DRAWINGS

In the accompanying drawings which form a part of the specification and are to be read in conjunction therewith and in which like reference numerals are used to indicate like parts in the various views.

DETAILED DESCRIPTION OF THE INVENTION

Figure 1:
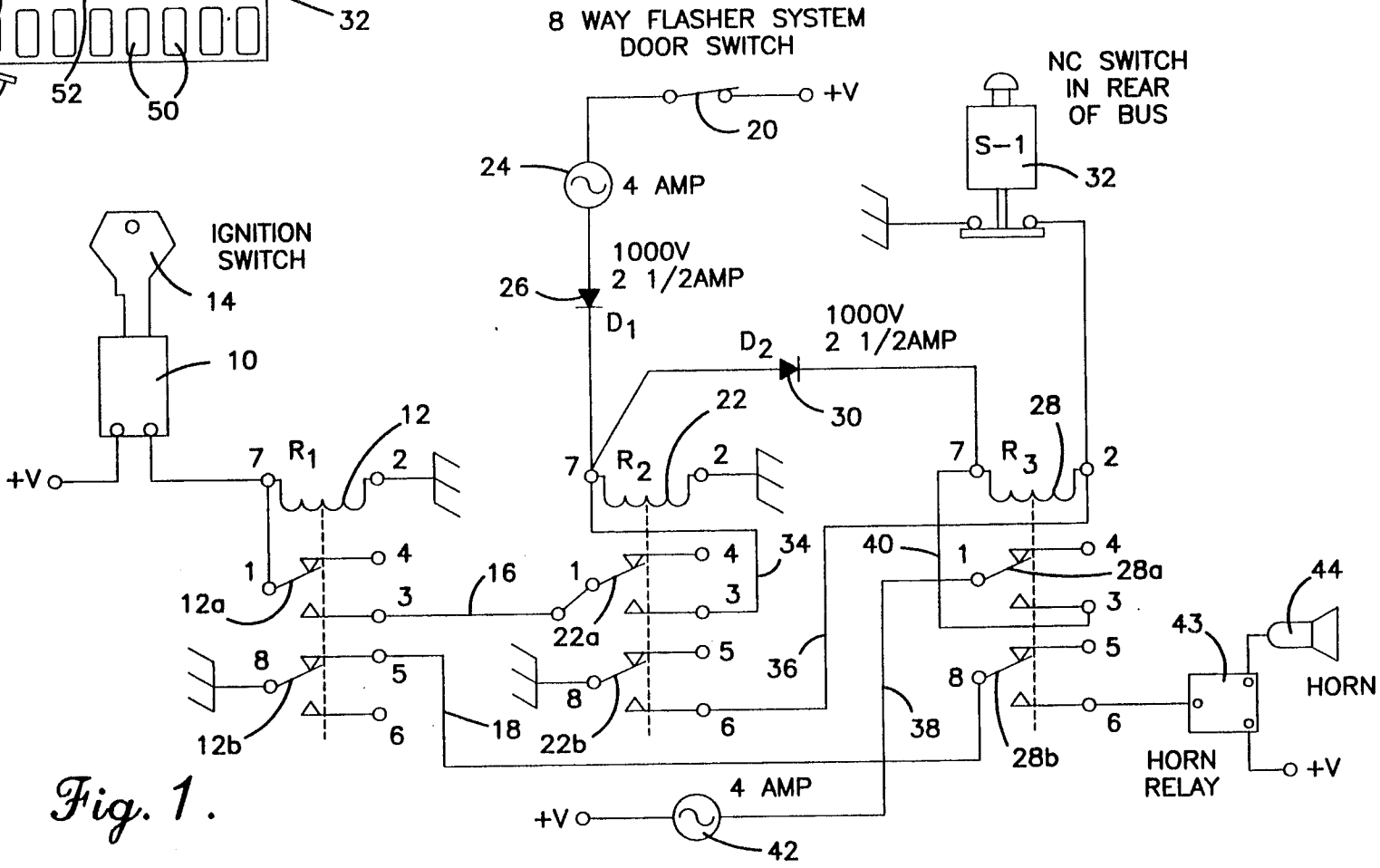
FIG. 1 is an electrical schematic of a vehicle alarm system constructed according to a preferred embodiment of the present invention.

Referring now to the drawings in more detail and initially to FIG. 1, the present invention is directed to an alarm system which may be installed in a bus or other vehicle. Numeral 10 designates the existing ignition switch of school bus in which the system is installed. One side of the switch 10 connects with the positive terminal of the vehicle battery, and the other side is grounded through a relay coil 12. An ignition key 14 controls the on-off condition of the switch 10 and thus controls the energization and deenergization of relay coil 12.

The relay coil 12 controls two sets of contacts 12*a* and 12*b*. When the coil 12 is deenergized, the first set of contacts 12*a* is in an open circuit position. When the coil is energized, the contacts 12*a* are switched to connection with a conductor 16, thus making battery power available to conductor 16 through the ignition switch 10 and the contacts 12*a*. The second set of contacts 12*b* is in an open circuit condition when coil 12 is energized. When coil 12 is deenergized, contacts 12*b* provide a ground connection for a conductor 18.

The safety system for the bus in which the alarm system is installed includes an 8-way flasher system having a door switch 20. The door switch 20 is normally open but closes whenever either the front or rear door of the bus is open to admit or let off passengers. When switch 20 is closed, battery power is made available to a relay coil 22 through a fuse 24 and a diode 26. The other side of coil 22 connects with ground. When switch 20 is closed, the positive side of the battery is also connected with another relay coil 28 through a diode 30. The other side of the relay coil 28 is connected with ground through a path extending through a normally closed disable switch 32 which is located in the rear of the bus. The disable switch 32 may be a push button switch which can be opened by depressing it and which closes again when released.

Relay coil 22 is part of an override relay which includes two sets of contacts **22*a* and 22*b* controlled by coil 22. In the deenergized condition of coil 22, the contacts 22*a* are in an open circuit condition. However, when coil 22 is energized, contacts 22*a* provide a connection between conductor 16 and another conductor 34 which leads to coil 22 and also connects with coil 28 through diode 30. The other contacts 22*b* are in an open circuit condition when coil 22 is deenergized. When coil 22 is energized, contacts 22*b* provide a ground connection for coil 28 through a conductor 36**.

The final relay is an arming relay which includes the coil 28 and two sets of contacts **28*a* and 28*b* controlled by the coil 28. When coil 28 is deenergized, both sets of contacts 28*a* and 28*b* are in an open circuit condition. When coil 28 is energized, contacts 28*a* provide a connection between a pair of conductors 38 and 40, the latter of which extends to coil 28 and the former of which receives positive battery voltage through a fuse 42. In the energized condition of coil 28, contacts 28*b* connect line 18 with a horn relay 43 which controls an audible horn 44 existing in the bus. The relay 43 receives positive battery voltage and activates the horn 44** when energized in order to produce a constant audible alarm signal.

Figure 2:
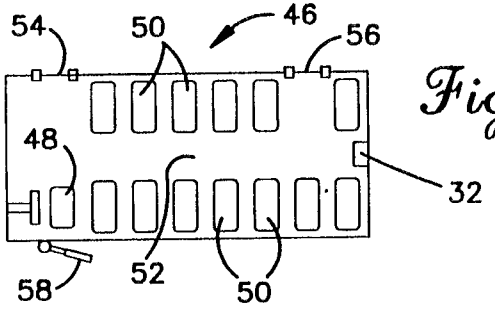
FIG. 2 is a diagrammatic plan view of a school bus in which the alarm system of the present invention is installed.

Referring now to FIG. 2, a school bus 46 is depicted diagrammatically and includes a driver's seat 48, a plurality of passenger seats 50 on opposite sides of the bus separated by an aisle 52, and front and back doors 54 and 56, respectively. The back door 56 is an emergency door that is normally used only for emergency evacuation of the bus. The door switch 20 is closed whenever door 54 is opened. At the same time, a stop sign 58 or other warning sign mounted on a pivotal arm is pivoted outwardly to provide a stop signal to other motorists, and the flashing lights of the bus are also energized as a warning signal.

The disable switch 32 is situated at the rear of the bus 46 so that it is necessary for the driver to walk the complete length of the aisle 52 in order to operate the disable switch.

In operation of the alarm system, the relay of which coil 12 is a part acts as an ignition relay which is energized whenever the ignition switch 10 is on. Contacts **12*b* are then switched to disconnect the ground path for the horn relay 43 to prevent the alarm system from activating the horn 44 whenever the ignition is on. The horn can still be actuated manually in the normal way. Contacts 12*a* are also switched to make battery power available through the ignition switch to line 16**.

The other two relays are normally deenergized. However, as soon as door 54 is opened the first time, switch 20 closes to energize relay coil 22 and to also energize relay coil 28 via the ground path that passes through the normally closed disable switch 32. Relay contacts **22*a* are then switched to connect lines 16 and 34 to provide a holding circuit which maintains coil 22 in the energized state so long as the ignition switch 10 remains on. Consequently, relay coil 22 remains energized even after the door switch 20 opens upon closing of door 54**.

When coil 22 is initially energized, contacts **22*b* are also switched to provide a ground path for relay coil 28 (via line 36) that is an alternative to the path extending through the disable switch 32. Relay contacts 28*a* are switched to connect lines 38 and 40, thus providing a holding circuit for maintaining coil 28 energized along a path that extends through fuse 42, line 38, contacts 28*a*, line 40, coil 28, and the alternative paths to ground that extend through switch 32 in one case and line 36 and the contacts 22*b* in the other case. Once coil 28 has been energized upon the initial closing of the door switch 20, it remains energized so long as either coil 22 remains energized or the disable switch 32** remains closed.

Relay coil 28 forms part of an arming relay which arms the alarm system by switching contacts **28*b* such that they connect line 18 with the horn relay 43. This connection remains established as long as relay coil 28 remains energized. In this armed state of the alarm system, it is in a condition to be activated when the ignition switch 10 is turned off, as the horn relay 43 is then activated through relay contacts 28*b* and 12*b* to sound the horn 44**.

In this manner, the alarm system is automatically armed as soon as door 54 is initially opened, and it remains armed thereafter. It is noted that depression of the disable switch 32 is ineffective to sound the horn because relay coil 28 remains energized through the alternative ground path that extends through line 36 and contacts **22*b* even if switch 32 is open. Consequently, if children or other passengers in the bus should depress the disable switch 32** while the bus is operating, the alarm system is not affected and remains armed.

When the last stop has been made and the bus driver returns the bus 46 to its storage yard or other storage area, the key 14 is turned off to shut off the ignition switch 10. This deenergizes coil 12 and causes contacts **12*b* to switch to the position shown in FIG. 1 to complete the circuit through the horn relay, thus energizing the horn 44. The switching of relay contacts 12*a* causes relay coil 22 to deenergize, thus switching both of its sets of contacts 22*a* and 22*b* to the open circuit positions. Contacts 22*a* then prevent coil 22 from being energized again when the ignition is turned on, and contacts 22*b* interrupt the alternative ground path for relay coil 28. However, relay coil 28** remains energized even after the ignition has been turned off.

The bus driver can silence the horn 44 immediately by turning the ignition switch 10 back to the on position in order to energize coil 12 again and switch contacts **12*b* to the open circuit condition where they interrupt the horn relay current path. Since coil 28 remains energized, the alarm system remains armed and the horn will sound again if the driver turns the ignition switch off again. In order to prevent the horn from sounding when the ignition switch is shut off again, it is necessary for the driver to walk the full length of the aisle 52 in order to gain access to the disable switch 32 and depress it, thus interrupting the only remaining ground path for relay coil 28. Coil 28 is then deenergized and the alarm system is disarmed due to relay contacts 28*a* and 28*b* switching to the open circuit positions. When the enable switch 32 closes again, coil 28 remains deenergized and the alarm system remains disarmed. The driver can then return to the front of the bus and turn the ignition switch 10** off without sounding the horn.

It is thus evident that before the driver can store the bus without the horn sounding, it is necessary for him to walk the full length of the bus and operate the disable switch 32. Consequently, the driver will necessarily notice the presence of any passengers that accidentally remain on board the bus, and sleeping school children and others will not inadvertently be locked inside of the bus overnight or for any other period.

As previously indicated, the relay of which coil 28 is a part is an arming relay which is energized as soon as the door switch 20 is initially closed and thereafter remains energized by the holding circuit that is established through relay contacts 28*a* and the two alternative ground paths described previously. Before coil 28 can be deenergized, the ignition must first be shut off to interrupt the path through relay contracts 22*b*, and the disable switch 32 must then be manually depressed. Consequently, the alarm system is automatically armed as soon as the door switch 20 is closed, and the driver cannot disarm it or otherwise tamper with the alarm system in a manner to prevent it from operating as intended.

If a bus does not include a door switch but instead has a red warning light system that is activated by the driver each time the bus stops to load or unload passengers, the alarm system of the present invention differs slightly from what has been described, in that the relay coils 22 and 28 are arranged to be energized when the warning light system is first activated rather than when the door switch is first closed. Otherwise, the system can be arranged as previously described.

The relay of which coil 22 is a part acts as an override relay which provides an alternative ground path for coil 28 through contacts 22*b*. Since coil 22 is energized when the door switch 20 is initially closed and thereafter remains energized so long as the ignition is on, it prevents the disable switch 32 from being effective to disarm the alarm system until such time as the ignition switch 10 has been shut off (at the end of the bus route).

The alarm system in the present invention may be installed as original equipment in a bus or other vehicle, or it may be installed as add-on equipment. In either case, it is highly effective in preventing passengers such as small school children from being accidentally locked inside of a bus or other vehicle during overnight or over the weekend storage of the vehicle.

It should be understood that transistors or other solid state components can be included in the system in place of the relays, and it also should be understood that the function of the circuit can be implemented by different circuit arrangements and configurations.

From the foregoing, it will be seen that this invention is one well adapted to attain all the ends and objects hereinabove set forth together with other advantages which are obvious and which are inherent to the structure.

It will be understood that certain features and subcombinations are of utility and may be employed without reference to other features and subcombinations. This is contemplated by and is within the scope of the claims.

Since many possible embodiments may be made of the invention without departing from the scope thereof, it is to be understood that all matter herein set forth or shown in the accompanying drawings is to be interpreted as illustrative and not in a limiting sense.

Having thus described the invention, I claim:

1. An alarm system for a bus having a plurality of passenger seats and an ignition switch with on and off conditions, said system comprising:

alarm means for generating an alarm signals, said alarm means having a disarmed state in which said alarm means is disabled to prevent generation of the alarm signal and an armed state in which said alarm means is enabled to generate the alarm signal when he ignition switch is placed in the off condition after having been in the on condition;

means for effecting the armed state of said alarm means; and an alarm disable switch for interrupting the alarm signal, said disable switch being located to the rear of the seats and being operated manually.

2. The alarm system of claim 1, wherein said disable switch is operable to effect the disarmed state of said alarm means.

3. The alarm system of claim 2, including means for preventing operation of said disable switch from effecting the disarmed state of said alarm means unless the ignition switch has first been placed in the off condition after having been in the on condition.

4. The alarm system of claim 1, wherein:

the bus includes a safety system having a door switch activated by opening a door of the bus; and said means for effecting the armed state of said alarm means is activated upon activation of the door switch and thereafter maintains the armed state of the alarm means until the ignition switch is placed in the off condition and said disable switch is operated.

5. The alarm system of claim 4, wherein said disable switch is operable to effect the disarmed state of said alarm means.

6. In a passenger vehicle having plural rows of passenger seats and an ignition switch with on and off conditions, an alarm system comprising:

alarm means for generating an alarm signal when enabled;

means for effecting an armed state of said alarm means;

means for enabling said alarm means in response to the ignition switch being placed in the off condition while the alarm means is in the armed state; and an alarm disable switch for disabling said alarm means, said disable switch being manually operated and being situated in the vehicle at a location accessible only to an operator who passes the passenger seats, whereby a passenger remaining in one of the seats will be noticed by the operator.

7. The alarm system of claim 6, wherein said disable switch is operable to effect a disarmed state of the alarm means in which the alarm means is disabled.

8. The alarm system of claim 7, including means for preventing operation of the disable switch from effecting the disarmed state of the alarm means unless the ignition switch has first been placed in the off condition after having been in the on condition.

9. The alarm system of claim 6, wherein:

said alarm means comprises a first electric circuit having a completed condition in which the alarm means is enabled and an interrupted condition in which the alarm signal is disabled to prevent generation of the alarm signal;

said means for effecting the armed state of said alarm means comprises a second electric circuit having a completed condition in which the alarm means is armed and an interrupted condition in which the alarm means is disarmed;

said disable switch is normally effective to complete the second circuit but may be manually operated to interrupt the second circuit.

10. An alarm system for a bus having a plurality of seats, an ignition switch with on and off conditions and a safety system with a door switch activated by opening a door of the bus, said alarm system comprising:

alarm means for generating an alarm signal when enabled;

means for arming said alarm means when the door switch has been activated and thereafter maintaining the armed state of the alarm means when the door switch is deactivated, said alarm means being in a condition to be enabled when in the armed state;

means for enabling said alarm means when the ignition switch is placed in the off condition while the alarm means is in the armed state; and an alarm disable switch for disabling said alarm means, said disable switch being located in the rear of the bus behind the seats and being operated manually.

11. The alarm system of claim 10, wherein:

the bus has an audible horn; and said alarm means comprises means for activating the horn.

12. The alarm system of claim 10, wherein said disable switch is operable to effect a disarmed state of the alarm means in which the alarm means is disabled.

13. The alarm system of claim 12, including:

disarm override means for preventing the disable switch from disarming the alarm means when said override means is activated; and means for activating said override means when the door switch has been activated and thereafter maintaining the activated state of the override means until the ignition switch is placed in the off condition.

* * * * *